United States Patent [19]

Bunker

[11] 4,201,108

[45] May 6, 1980

[54] ELECTRIC STRINGED INSTRUMENT

[75] Inventor: David D. Bunker, Sumner, Wash.

[73] Assignee: Bunker Instruments, Inc., Tacoma, Wash.

[21] Appl. No.: 908,377

[22] Filed: May 22, 1978

[51] Int. Cl.[2] ..... G10D 1/08; G10D 3/04; G10D 3/14

[52] U.S. Cl. ..... 84/1.16; 84/1.15; 84/267; 84/298; 84/304; 84/307

[58] Field of Search ..... 84/1.14, 1.15, 1.16, 84/267, 290, 291, 292, 293, 297 R, 298, 299, 304, 307, 312 R

[56] References Cited

U.S. PATENT DOCUMENTS

| | | | |
|---|---|---|---|
| 2,964,985 | 12/1960 | Webster | 84/1.15 |
| 3,251,257 | 5/1966 | Bunker | 84/267 |
| 3,396,284 | 8/1968 | Scherer | 84/1.16 |
| 3,396,621 | 8/1968 | Pycus | 84/293 |
| 3,483,303 | 12/1969 | Warner | 84/1.15 |
| 3,657,462 | 4/1972 | Robinson | 84/1.16 |
| 4,004,485 | 1/1977 | Hiscott | 84/304 |

*Primary Examiner*—J. V. Truhe
*Assistant Examiner*—William L. Feeney
*Attorney, Agent, or Firm*—Seed, Berry, Vernon & Baynham

[57] ABSTRACT

A stringed instrument is disclosed which incorporates improved design and performance features. An elongated body, hereinafter called the wedge, contains in itself all necessary components and parts making it a totally playable instrument with or without a pair of removable wing bodies. One purpose of the wing body attachments is to provide flexibility for modular electronic add-on components for use with new modern amplification devices. Also the wing bodies may be changed to provide a varity of instrument body designs, colors, finishes and fabrics. The sound produced by each of the strings of the instrument is enhanced by providing each string with at least one individual magnetic pickup which is individually adjustable to that string for optimum performance. Each string is also provided with its own individual bridge support which is completely separated from each other bridge support to prevent any acoustical and/or electrical cross-feed. A fine tuning system is provided to more precisely and more easily tune each string. This fine tuning can also act as an electrically controlled tuning means. A metal reflective shield surrounds the wedge body of the instrument, the shield acting to enhance the high frequency sounds produced by the strings, to shield or lock out unwanted signals to the electrical components, and is used for mounting or holding the wing bodies to the wedge.

7 Claims, 6 Drawing Figures

ELECTRIC STRINGED INSTRUMENT

BACKGROUND OF THE INVENTION

1. Field of the Invention

This invention relates to improvements in the construction and design of electrical stringed musical instruments, particularly guitars.

2. Description of the Prior Art

The conventional electric guitar used by most performers today is formed by an acoustical body or a single solid wooden block and utilizes ganged magnetic pickups to inductively pick up the sounds of the strings for amplification. The strings of the instrument slidably pass over a unitary supporting bridge member. Because of the unitary bridge member and the ganged magnetic pickups, the amplified sound of each string is not as clear and "clean" as desired but is distorted by acoustical and/or electrical cross-feed from adjacent strings.

The instrument described in this application makes use of a steel rod in the neck of the instrument to overcome or avoid neck and fingerboard warping under tension of the strings as described in U.S. Pat. No. 3,251,257 filed in the name of the applicant herein.

SUMMARY OF THE INVENTION

It is a primary object of this invention to provide a musical stringed instrument with removable "snap-on" wing body portions, allowing the player of the instrument selection of body portions having different colors, designs, fabrics, finishes, or electronic add-on components.

It is a further object of this invention to provide a musical stringed instrument having individual magnetic pickups for each string of the instrument, thereby providing a "clean" sound free of distortion.

It is a further object of this invention to provide a musical stringed instrument having individually adjustable bridge support members for each string to prevent acoustical and/or electrical cross-feed from adjacent strings.

It is a further object of this invention to provide a musical stringed instrument having means for fine tuning each of the strings so as to more precisely and more easily tune each string.

It is a further object of this invention to provide a musical stringed instrument having a metal reflective shield wrapped around the body of the instrument which may be connected to the individual bridge supports and the string support of the neck for enhancing the "high" frequency sounds of each of the strings.

These and other objects are accomplished by a stringed instrument having a pair of elongated wing bodies which are removably securable to opposite sides of the main body of the stringed instrument adjacent the strings. The wind bodies provide the user of the instrument the flexibility of changing the color, finish and shape of the instrument. The stringed instrument uses one or more magnetic pickups for each individual string. Further, each string is supported on its own individual string supporting bridge which has no contact with adjacent string supporting bridges supporting other of the strings thereby preventing acoustic and electrical cross-feed. Fine tuning means are provided for each of the strings between the string supporting bridge and the string tuning shafts to obtain more precise tuning of the individual strings. The instrument may also have a reflective metal shield surrounding the body and connected to the bridge support members and string support for enhancing the "high" frequency sounds of the individual strings when the instrument is played.

DETAILED DESCRIPTION OF THE PREFERRED EMBODIMENTS

Figure 1:
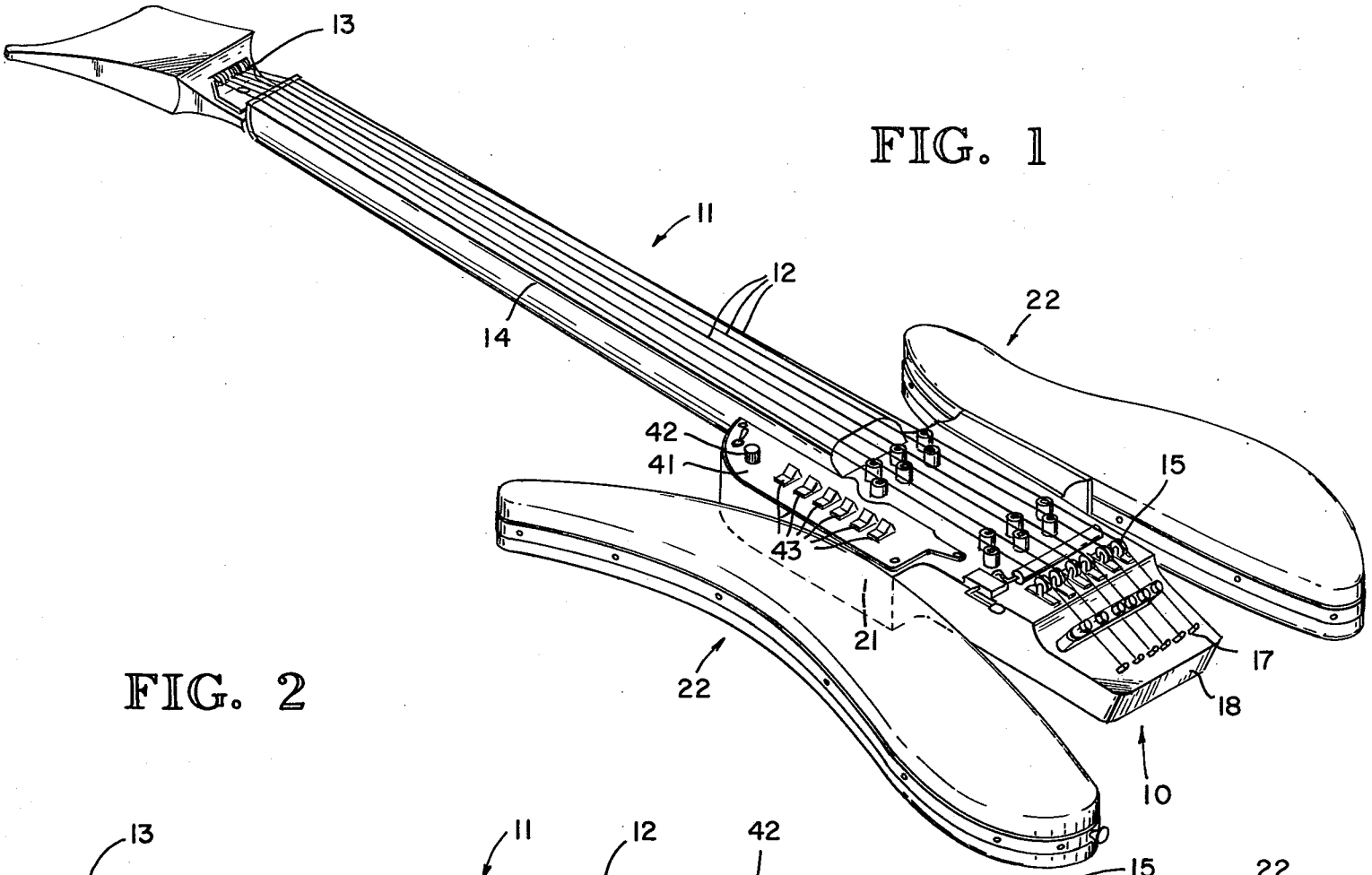
FIG. 1 is a perspective view of the stringed instrument of this invention.

Referring to FIG. 1, the stringed instrument comprises a main body portion 10 connected to an elongated neck 11. A plurality of strings 12 are anchored at one end to a flanged head plate 13 and extend across the fingerboard 14 of the neck and supporting bridge members 15 mounted on the lower end 16 of the body and are individually wound on tuning shafts 17 mounted in and extending vertically from a lower flange 18 of the body of the musical instrument. The body 10 is generally formed from a solid wood block which may vary in thickness from two to four inches and may be of any desired shape. The upper end of the body 10 has a notch 19 therein for receiving the neck of the instrument as will be described. The underside of the body block has a hollow portion 20 for holding electronic components and wiring of the instrument. The body portion 10 has planar sidewalls 21 which are adapted to receive the elongated wing bodies.

Figure 2:
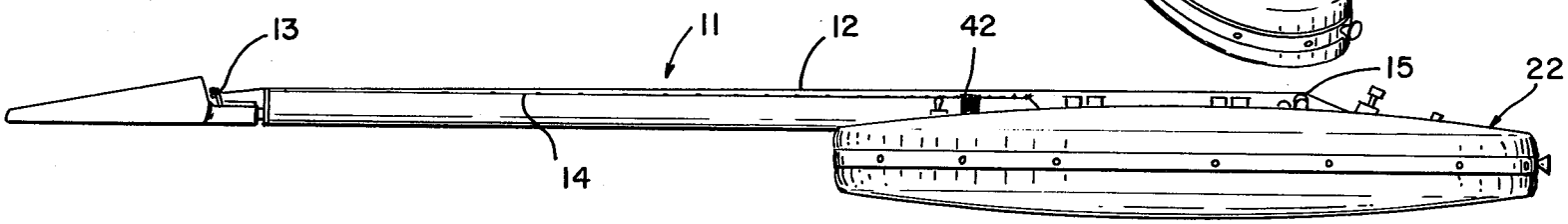
FIG. 2 is a side elevational view of the instrument of FIG. 1.
Figure 3:
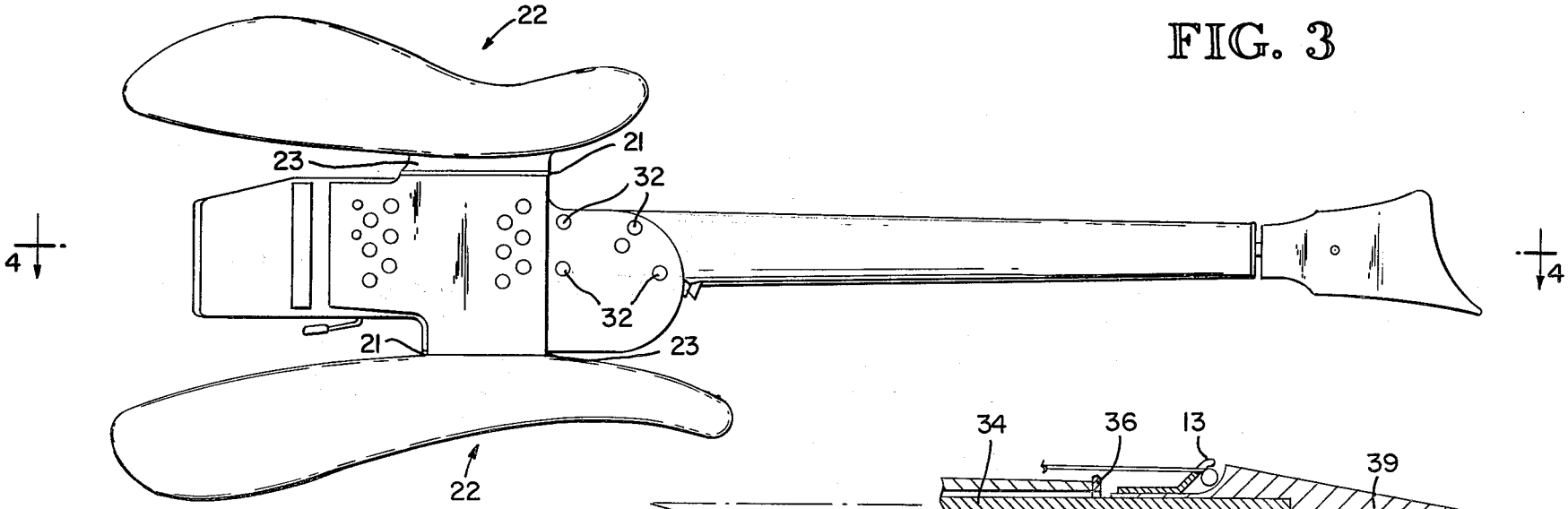
FIG. 3 is a rear view of the instrument of FIG. 1.
Figure 5:
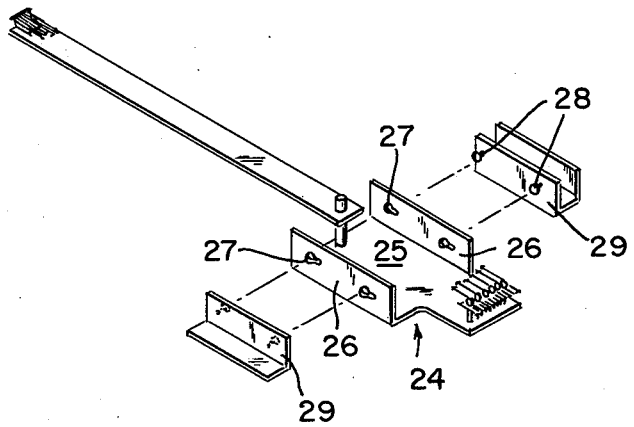
FIG. 5 s a partial perspective view of the metal reflective shield surrounding the body of the instrument, emphasizing the continuous metal connection between the reflective shield, metal bar extending the length of the neck of the instrument, the string support, the bridge supports and the strings.

The wing bodies 22 are illustrated in FIGS. 1, 2 and 3 and include sculptured shaped portions of wood or metal alone or covered with a decorative padded surface. Each of the wing bodies includes a planar portion 23 adapted to mate with a respective planar sidewall 21 of the body of the musical instrument to be secured thereto. The wing bodies 22 may be secured to the body portion 10 in any desired manner. One such method is illustrated by FIG. 5 wherein a metal shield 24 having a planar bottom wall 25 and upstanding sidewalls 26 is fitted over the body of the instrument and secured thereto. Each of the sidewalls 26 of the shield 24 includes teardropshaped slots 27 therein adapted to receive corresponding posts 28 extending from metal flanges 29 secured over each of the planar portions 23 of wing body 22 for removably securing the wing body to the main body 10 of the musical instrument.

The neck 11 of the instrument is preferably of wood and is overlayed along its full length on its flat upper surface with a substantially flat fingerboard 14 within which metal frets 30 are transversely set as is conventional. The lower end 31 of the wooden neck fits in the notch 19 provided in the body portion 10 and is secured thereto by one or more screws 32 threaded upwardly from the bottom wall of the body 10 into the lower end of the neck.

Figure 4:
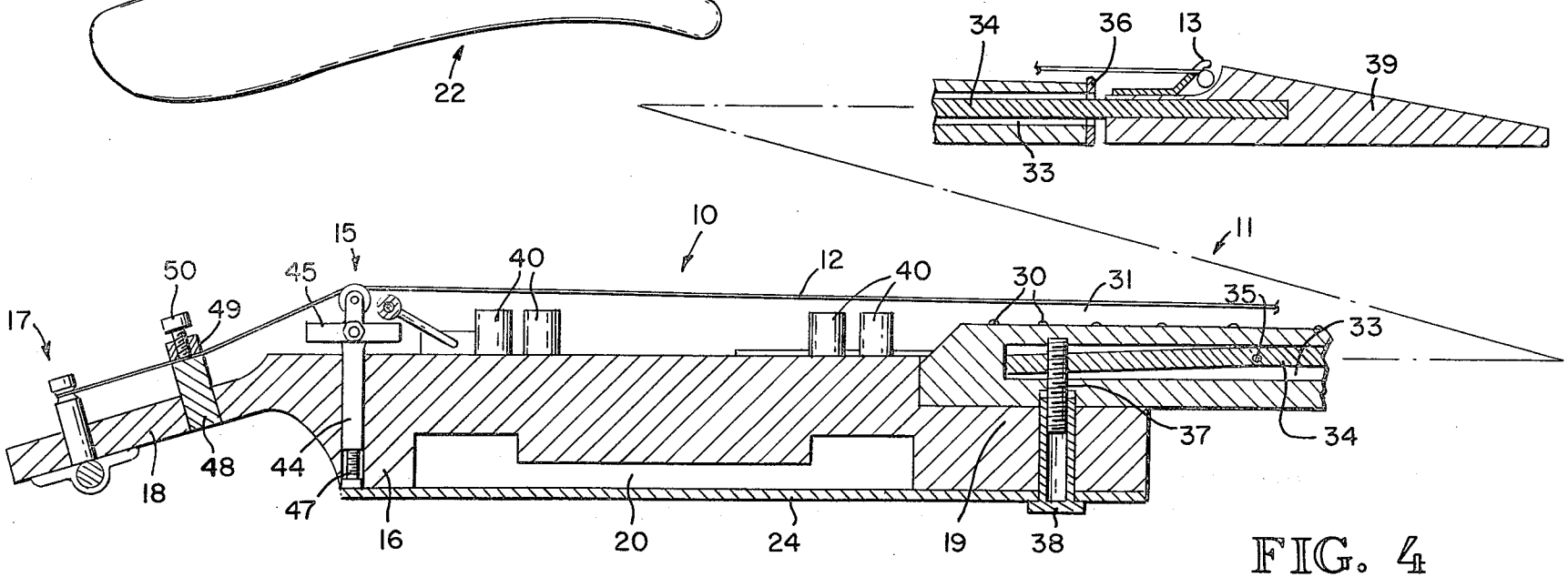
FIG. 4 is a cross-sectional view along section line 4—4 of FIG. 3 of the instrument.

The neck 11 of the instrument includes means to overcome or avoid neck and fingerboard warpage under tension of the strings as is disclosed in applicant's prior U.S. Pat. No. 3,251,257 which is hereby incorporated by reference. Referring to FIG. 4, the neck has a straight channel 33 extending virtually its entire length as illustrated in FIG. 4. The channel 33 is adapted to receive a metal bar 34 which terminates at its inner end just short of the end of the wooden neck and extends at its other end a short distance beyond the terminating end of the wooden neck. The metal bar 34 is pivotally mounted near its inner end on a cross-shaft 35 that extends horizontally through the lower end of the neck as illustrated in FIG. 4. The metal bar 34 is free of the walls of the channel 33. At its outer end the metal bar 34 is contained freely in a guide slot 36 that is applied over the terminating end surface of the neck. At its inner end an adjustable screw bolt 37 is secured to the metal bar 34. The screw bolt is threaded through an internally threaded metal sleeve 38 that is press fitted within the body 10 as illustrated in FIG. 4. By adjustment of this screw bolt 37 relative to sleeve 38, the metal bar 34 may be adjusted downwardly or upwardly at its outer end to regulate spacing of the strings 12 from the fingerboard 14. The metal bar 34 is not only useful for this purpose but also relieves the wooden neck of the strain that is normally applied to the wooden neck by the tension of the strings, thus avoiding warping or bowing of the neck. On the outer end of the metal bar 34 is located a string anchoring plate 13 which is rigidly fixed to the bar 34. The plate is turned angularly to extend slightly above the level of the fingerboard 14. The upturned portion of the plate 13 is bored to receive the ends of the strings 12 therethrough. Surrounding the plate 13 and the extended portion of the metal bar 34 is a decorative wooden portion 39.

Each string 12 of the instrument is provided with one or more individual magnetic pickups 40. The magnetic pickups 40 are connected to transmit the string tones to suitable amplifiers which are not shown. Referring to FIGS. 1 and 4, there may be two magnetic pickups for each string. One set of magnetic pickups is located near the neck of the instrument and the other set is located near the bridge supporting member 15. The magnetic pickups nearest the neck of the instrument pick up the low frequencies of the strings while those pickups nearest the bridge support member pick up the high frequencies of each of the strings. Referring to FIG. 1, the body 10 includes a panel 41 on which is mounted a knob and a number of switches. The knob 42 is a volume control while the individual switches 43 control connection of the respective sets of magnetic pickups. The panel controls are adjacent the strings 12 so that the player of the instrument can adjust the type of sound wanted easily and quickly.

Figure 6:
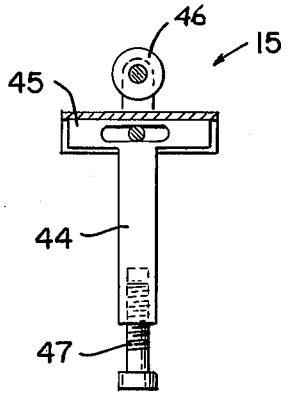
FIG. 6 is a side elevation view of one of the bridge supports.

To prevent acoustical and/or electrical cross-feed between the strings which is a primary cause of "fuzzy" sound, each string has its own bridge support member which is individually adjustable, vertically and longitudinally, and totally separated from each of the other bridge support members. Referring to FIG. 4 and FIG. 6, each bridge support member includes a vertical shaft portion 44 that is press fitted in a drilled opening in the body 10 of the instrument. A horizontal channel member 45 is positioned on the upper end of the vertical rod. Within the channel is slidably mounted a bridge support 46. The bridge support 46 may be moved horizontally along the channel and locked in place by a suitable lock mechanism such as a lock nut. Likewise the vertical shaft 44 may be adjusted vertically by adjustment of the screw 47 extending into the internally threaded vertical shaft 44 from the bottom surface of the body 10. Each of the bridge support members is preferably made of solid brass which is heavily chromed. Each bridge support is in intimate contact with the wood body 10 so that the sounds produced by the strings are enhanced by the resonance provided by the wood body 10.

Fine tuning means are positioned between the bridge support members 15 and the tuning shafts 17. The fine tuning means enables the player of the instrument to obtain a much more precise tune with greater ease than by using the conventional tuning shafts. It is important to note that the acoustical and electrical separation of the strings is maintained by the fine tuning means as the strings pass therethrough. The fine tuning means includes an elongated block 48 press fitted in an opening in the wood body 10 as illustrated in FIG. 4. Slots 49 ae provided in the block 48 through which the individual strings pass. Atop the block and directly over each string, a series of thumb screws 50 are threadedly extended through the upper part of the block. The lower end of each thumb screw rests against an individual string. By turning the thumb screw, the string can be tightened or loosened as may be desired to finely tune the string.

FIG. 5 illustrates the metal to metal connection of the strings 12, head plate 13, metal bar 34, reflector shield 24 and individual bridge support members 15. The metal shield 24 surrounding the body 10 is in contact with the strings 12 through the metal bar 34 and bridge support members 15. This enables the player to obtain high frequency sounds which cannot be obtained by use of wooden body alone for resonance. The shield 24 acts to isolate the sound produced by the strings from external interference. The shield 24 also serves as a mounting plate for the wing bodies 22 as has been described as well as enables the player of the instrument to obtain high frequencies which cannot normally be obtained by use of a wooden body alone.

The musical instrument is unique in appearance and employs unique engineering concepts which create sounds which are "clean" and precise.

I claim:

1. A stringed instrument having a body portion with an elongated neck structure extending therefrom, the neck structure having a finger board mounted thereon and extending along the neck member, a string supporting bridge mounted on the body portion in alignment with the neck member, a complement of strings for the instrument anchored at one end to the lower end of the body portion spaced from the bridge and extending along the neck and finger board and anchored at the other end to the upper end of the neck, and electrical pickup means for the strings, the improvement comprising:

a metal plate surrounding the body portion except for the upper surface thereof adjacent the strings, the metal plate including slots in each of the side surfaces of the body portion, a pair of separate elongated wing bodies of sculptured design each wing body having protruding stems extending therefrom adapted to be received in the respective slots in each of the side surfaces of the body portion for securing the wing bodies to the body portion so that the wing bodies can be removably secured to opposite sides of the body portion adjacent the strings, said wing bodies providing the user of the instrument the flexibility of adding electronic add-on components or changing the color, finish and shape of the instrument.

2. The stringed instrument of claim 1 wherein the electrical pickups include at least one individual electrical pickup for each individual string, each electrical pickup mounted on the body portion beneath each individual string.

3. The stringed instrument of claim 1 wherein the string supported bridge is composed of totally separate string support bridges for each individual string so that each individual string has its own individual string to prevent acoustic and electrical crossfeed.

4. The stringed instrument of claim 3 wherein each string supporting bridge is individually adjustable, vertically and longitudinally, with respect to the body portion.

5. The stringed instrument of claim 1 including string tuning shafts mounted on the lower end of the body spaced from the string supporting bridge, each string individually attached to its corresponding tuning shaft.

6. The stringed instrument of claim 4 including individual fine tuning means for each of the strings mounted on the body portion between the string supporting bridge and the string tuning shafts enabling a musician to obtain a more precise tuning of the individual strings than by adjustment of the string tuning shafts.

7. The stringed instrument of claim 6 wherein the fine tuning means include a member mounted on the body portion between the bridge and the string tuning shafts having vertical slots therein, one for each of the strings and allowing the strings to pass therethrough, an upper member over the slots secured to the slotted member, individual adjustable fine tuning shafts threaded through the upper member and bearing against the string passing through the slotted member, the fine tuning shafts adjustable by the finger of the musician.

* * * * *